US008132663B2

(12) United States Patent
Nakai et al.

(10) Patent No.: US 8,132,663 B2
(45) Date of Patent: Mar. 13, 2012

(54) CONVEYOR TABLE OF CUTTING MACHINE

(75) Inventors: Kenji Nakai, Wakayama (JP); Reiji Arikita, Wakayama (JP)

(73) Assignee: Shima Seiki Mfg., Ltd., Wakayama-shi, Wakayama ( * ) Notice: Subject to any disclaimer, the term of this patent is extended or adjusted under 35 U.S.C. 154(b) by 167 days.

(21) Appl. No.: 12/740,555

(22) PCT Filed: Oct. 21, 2008

(86) PCT No.: PCT/JP2008/002978
§ 371 (c)(1),
(2), (4) Date: Apr. 29, 2010

(87) PCT Pub. No.: WO2009/060566
PCT Pub. Date: May 14, 2009

(65) Prior Publication Data

US 2010/0257989 A1 Oct. 14, 2010

(30) Foreign Application Priority Data

Nov. 7, 2007 (JP) ..... 2007-290218

(51) Int. Cl.
*B65H 29/16* (2006.01)

(52) U.S. Cl. ..... 198/688.1; 198/850; 83/101

(58) Field of Classification Search ..... 198/688.1, 198/698, 699.1, 850–853; 83/101, 941
See application file for complete search history.

(56) References Cited

U.S. PATENT DOCUMENTS

| | | | | | |
|---|---|---|---|---|---|
| 4,572,357 | A | * | 2/1986 | Pearl | 198/693 |
| 5,001,954 | A | * | 3/1991 | Galan et al. | 83/451 |
| 5,189,936 | A | * | 3/1993 | Gerber et al. | 83/409 |
| 5,228,554 | A | * | 7/1993 | Kuchta et al. | 198/635 |
| 5,282,407 | A | * | 2/1994 | Arikita | 83/422 |
| 5,358,226 | A | * | 10/1994 | Arikita | 269/21 |
| 5,596,917 | A | * | 1/1997 | Gerber et al. | 83/152 |

FOREIGN PATENT DOCUMENTS

| | | | |
|---|---|---|---|
| JP | 03026496 | A | 2/1991 |
| JP | 06305620 | A | 1/1994 |
| JP | 07214495 | A | 8/1995 |

* cited by examiner

*Primary Examiner* — Mark A Deuble
(74) *Attorney, Agent, or Firm* — Rothwell, Figg, Ernst & Manbeck, P.C.

(57) ABSTRACT

A conveyor table of a cutting machine capable of making a difference in level between a conveyor table and a air table small, and preventing a sheet material from shifting or collapsing with a simple configuration is provided. A pair of caterpillar tracks 10 formed by bridging a chain 11 over a pair of sprockets 12, 13 arranged at a carry-in side end and a carry-out side end in a conveying direction, a plurality of brush mounts 20 attached to the chain 11 in parallel to connect the caterpillar tracks 10, and a brush block 30 having bristles 32 arrayed on each of the brush mounts 20 are arranged. The brush mount 20 has a portion on the carry-in side fixed to the chain 11 and a portion on the carry-out side not fixed to the chain 11.

5 Claims, 7 Drawing Sheets

CONVEYOR TABLE OF CUTTING MACHINE

CROSS REFERENCE TO RELATED APPLICATION

This application is a 35 U.S.C. 371 National Phase Entry Application from PCT/JP2008/002978, filed Oct. 21, 2008, which claims the benefit of Japanese Patent Application No. 2007-290218 filed on Nov. 11, 2007, the disclosure of which is incorporated herein in its entirety by reference.

TECHNICAL FIELD

The present invention relates to a conveyor table for carrying in a sheet material to a cutting mechanism and carrying out a cut sheet material in a cutting machine for cutting the sheet material such as a knitted fabric and woof to a desired shape while automatically conveying.

BACKGROUND ART

A cutting machine 100 used to cut a sheet material such as a knitted fabric and woof is conventionally known (see FIG. 7). The cutting machine 100 is a device that automatically performs a series of operations of carrying in a stacked sheet material from a carry-in side air table 2 to a conveyor table 1, cutting the sheet material on a brush surface 1*s* of the conveyor table 1 with a cutting mechanism 4, and carrying out the cut sheet material from the conveyor table 1 to a carry-out side air table 3. The air tables 2, 3 of the configuration of the cutting machine 100 are configured to push up the sheet material by blowing air from the surface of the tables 2, 3 towards the sheet material placed on the surface to facilitate the carry-in and the carry-out of the sheet material. The conveyor table 1, on the other hand, is configured to absorb the sheet material by suctioning air from the surface of the brush surface 1*s* so that the sheet material does not position shift when cutting the sheet material. The surface of the stacked sheet material is covered with a vinyl cover to enhance the suction force of the sheet material by the conveyor table 1.

As described in FIG. 12 of Patent Document 1, a conventional conveyor table in the cutting machine is configured to include a caterpillar track including a pair of sprockets arranged on the carry-in side and the carry-out side and a chain bridged across the sprockets, a brush mount attached to a link of one part of the chain, and a bristle block (brush block) arrayed on the brush mount. In the conveyor table described in FIG. 12 of the document, the brush mount has the central part attached to every three links of the chain.

In such a configuration, however, a difference in level occurs between the conveyor table and the air table since the track drawn by the upper edge on the carry-in side of the brush block greatly bulges out at the corner portion of the caterpillar track on the carry-out side, as shown in FIG. 13 of the document. Although not shown in the document, the upper end on the carry-out side of the brush blocks also greatly bulges out at a corner portion of the caterpillar track on the carry-in side. Thus, the stacked sheet material may collapse when passing the difference in level thereby breaking the stacked state of the sheet material.

In the technique described in Patent Document 1, the brush mount is configured to be able to oscillate and displace with respect to the link of the chain, to which the brush mount is attached (see FIGS. 1, 5 of the document). The track drawn by the brush block is prevented from greatly bulging out by oscillating and displacing the brush mount at the corner portion of the caterpillar track. As a result, the difference in level between the conveyor table and the air table is made small compared to the conventional configuration as shown in FIGS. 12, 13 of the document.

[Patent Document 1] Japanese Laid-Open Patent Publication No. 6-305620

DISCLOSURE OF THE INVENTION

Problems to be Solved by the Invention

However, an oscillating mechanism needs to be arranged to all the brush mounts to be attached to the chain in the conveyor table of Patent Document 1, and thus the number of components is large and the productivity is not satisfactory.

In view of the above situations, it is a main object of the present invention to provide a conveyor table of a cutting machine capable of making a difference in level between the conveyor table and the air table small, and preventing a sheet material from shifting or collapsing with a simple configuration.

Means for Solving the Problems

The inventors reviewed various configurations for solving the above problems, and found that the drawbacks such as the shift and the collapse of the sheet material are significant on the carry-out side but are negligible on the carry-in side even if a difference in level greater than in the prior art is formed. The drawbacks of the stacked sheet material tend to easily occur on the carry-out side rather than on the carry-in side since the sheet material is cut to small pieces on the carry-out side and is susceptible to vibration and resistance when getting over the difference in level. The present invention has been contrived based on such knowledge.

In other words, the conveyor table of the cutting machine of the present invention includes a pair of caterpillar tracks formed by bridging a chain over a pair of sprockets arranged at a carry-in side end and a carry-out side end in a conveying direction, a plurality of brush mounts attached to the chain in parallel so as to connect the caterpillar tracks, and a brush block having bristles arrayed on each of the brush mounts. The conveyor table has features in that the brush mount is configured so that a portion on the carry-in side is fixed to the chain and a portion on the carry-out side is not fixed to the chain.

The configuration of the present invention is mainly provided to reduce the difference in level between the conveyor table and the air table on the carry-out side, but preferably similarly reduces the difference in level on the carry-in side. As one aspect of the present invention, the sprocket on the carry-in side may be arranged at a position lower than the sprocket on the carry-out side.

Furthermore, if the carry-in side sprocket is lower than the carry-out side sprocket, a guide cam for pushing up the chain may be arranged on the carry-in side so as to reduce a difference in height of the sprockets and to enable the brush mount to move to the carry-out side in a horizontal state.

The brush mount sent to the carry-out side from the sprocket on the carry-in side is in a state tilted from the horizontal state and becomes horizontal with the movement in the carry-out direction, but easily vibrates until stabilizing in the horizontal state. When the brush mount vibrates, a gap between the brush blocks adjacent in the conveying direction open and close, and the sheet material and the vinyl cover covering the sheet material tend to get caught between the brush blocks. In particular, the end of the vinyl cover running out from the sheet material tends to easily get caught, and the involved vinyl cover may knock against the difference in level between the conveyor table and the air table on the carry-out side. As one aspect of the present invention, the conveyor table preferably includes a carry-in side guide rail for suppressing vibration of the brush mount by sandwiching the chain from above and below near the carry-in side end at the upper surface side.

Furthermore, the brush mount easily vibrates, and adjacent brush blocks tend to easily open and close even when the brush mount in the horizontal state is sent to the sprocket on the carry-out side. Therefore, as one aspect of the present invention, the conveyor table preferably includes a carry-out side guide rail for suppressing vibration of the brush mount by sandwiching the chain from above and below near the carry-out side end at the upper surface side.

Effects of the Invention

According to the conveyor table of the cutting machine of the present invention, the position that becomes a starting point of the tilt of the brush mount shifts to the carry-in side than the conventional structure at a return corner portion on the carry-out side since the brush mount has the portion on the carry-in side fixed to the chain and does not have the portion on the carry-out side fixed to the chain. The more the starting point of the tilt of the brush mount shifts to the carry-in side, the smaller the track of the brush mount at the upper part on the carry-out side becomes, and thus the difference in level between the carry-out side air table and the brush surface can be made small. The configuration can be very easily implemented since the position on the carry-in side of the brush mount merely needs to be fixed to the chain.

The difference in level between the air table on the carry-in side and the conveyor table can be made small by arranging the sprocket on the carry-in side lower than the sprocket on the carry-out side. Thus, the shift and the collapse of the sheet material can be effectively suppressed not only on the carry-out side but also on the carry-in side.

Furthermore, the chain sent from the carry-in side sprocket can be rapidly pushed up to the horizontal position by arranging the guide cam even if the carry-in side sprocket is lowered with respect to the carry-out side sprocket. Thus, the upper end of the brush block can be guided to the carry-out side in a horizontal state. According to such a configuration, the chain is prevented from sagging to the carry-in side, which arises if the carry-in side sprocket is lower than the carry-out side sprocket.

Furthermore, the brush mount attached to the chain can be stabilized in the horizontal state so as not to vibrate by arranging a guide rail for sandwiching the chain sent from the sprocket from above and below on at least one of near the carry-in side end or near the carry-out side end. Thus, the brush blocks adjacent in the conveying direction are prevented from opening and closing.

DESCRIPTION OF SYMBOLS

Figure 1:
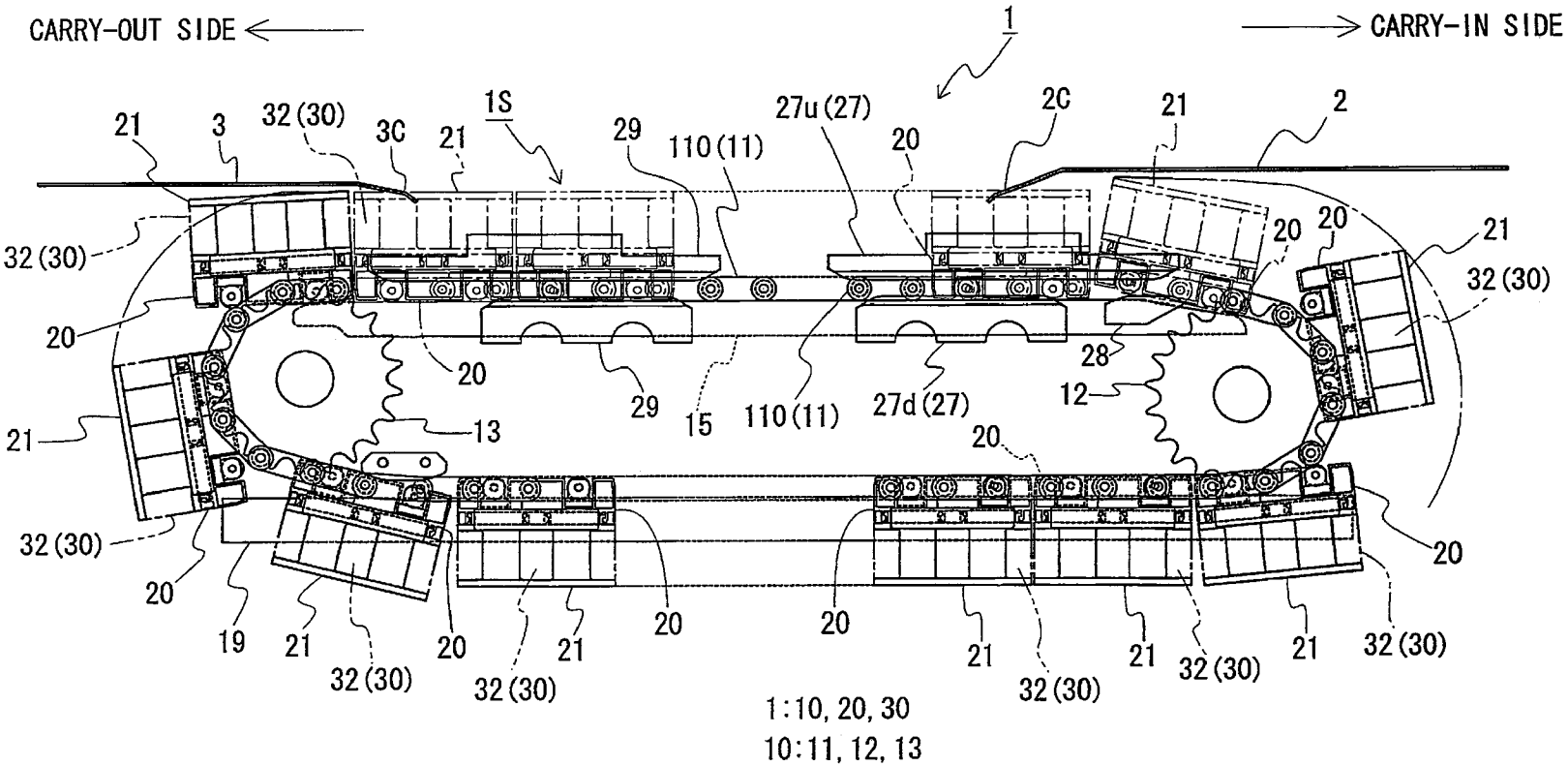
FIG. 1 is a schematic longitudinal cross-sectional view of a conveyor table shown in an embodiment.

100 cutting machine
1 conveyor table
1*s* brush surface
1F frame
10 caterpillar track
11 chain
11*f* fixing portion
110,110*a*, 110*b* link
12 carry-in side sprocket
13 carry-out side sprocket
15 guiding rail
17 plate-shaped piece
19 lower supporting rail
20 brush mount
21 fixing block
25 guiding roller
28 guide cam
26 nail portion
27 carry-in side guide rail
27*u* upper guide rail
27*d* lower guide rail
29 carry-out side guide rail
30 brush block
31 rectangular plate member
32 bristle
39 nail portion
2 carry-in side air table
2C carry-in side comb
3 carry-out side air table
3C carry-out side comb
4 cutting mechanism
41 beam
42 cutting head
5 cutting vinyl cover
6 sealing vinyl cover

DETAILED DESCRIPTION OF THE PREFERRED EMBODIMENT

An embodiment of the present invention will be described below with reference to the drawings.

<Overall Configuration>

Figure 7:
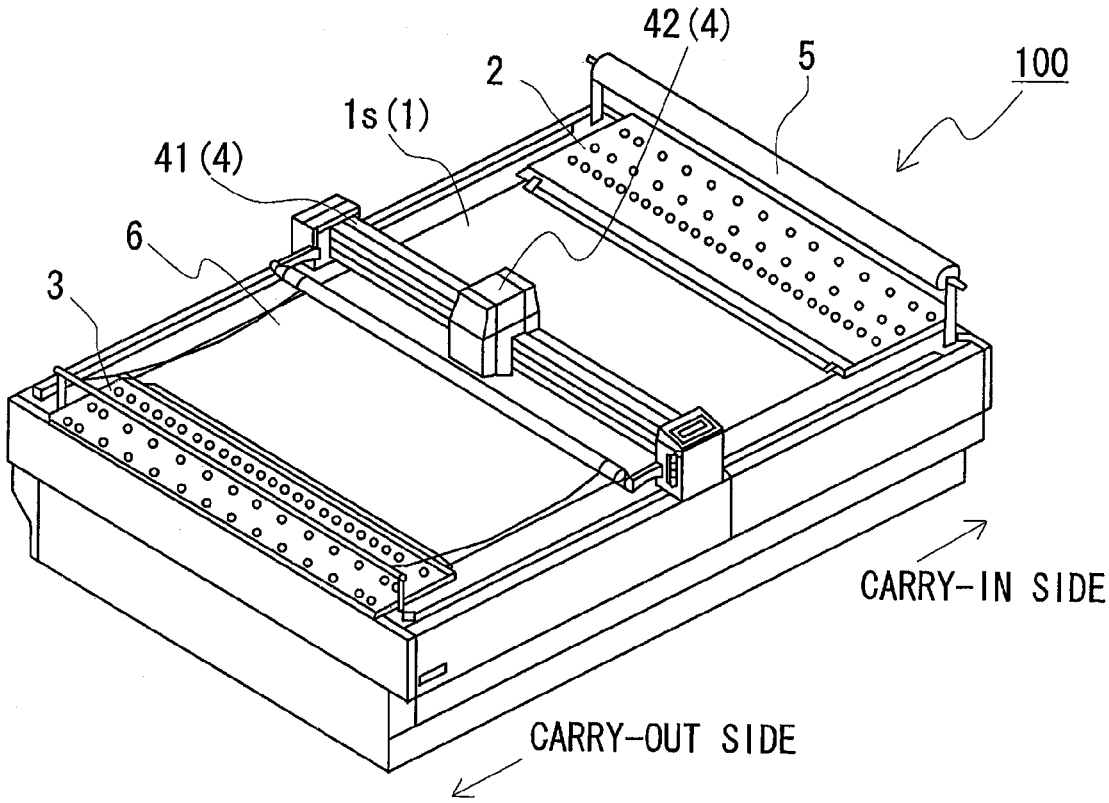
FIG. 7 is a perspective view showing a schematic configuration of a cutting machine.

A cutting machine shown in the present embodiment is a device, having an outer appearance similar to the conventional cutting machine already described with reference to FIG. 7, for cutting the stacked sheet material to a desired shape while conveying from the carry-in side to the carry-out side. A cutting machine 100 includes air tables 2, 3 arranged on the carry-in side and the carry-out side, a conveyor table 1 for conveying the sheet material from the carry-in side to the carry-out side between the air tables 2, 3, and a cutting mechanism 4 for cutting the sheet material on a brush surface 1*s* of the conveyor table 1.

The sheet material is first sent from the carry-in side air table 2 to the conveyor table 1 to cut the stacked sheet material with the cutting machine 100 having the above configuration. The carry-in side air table 2 has a plurality of air blowout ports formed at the upper surface so that the sheet material floats by the air blown out from the blowout ports thereby reducing the friction between the sheet material and the carry-in side air table 2 and facilitating the conveyance of the sheet material.

The sheet material is supplied to the conveyor table 1 with the surface covered with a sheet-like cutting vinyl cover 5 supplied from a roll arranged near the boundary of the carry-in side air table 2 and the conveyor table 1. The conveyor table 1 suctions air from the brush surface 1*s*, and closely attaches the sheet material, which surface is covered with the cutting vinyl cover 5, to the brush surface 1*s* to stably hold the stacked state of the sheet material.

The sheet material conveyed to the central part of the conveyor table 1 is cut to the desired shape by the cutting mechanism 4. The cutting mechanism 4 includes a cutting head 42 that moves on a beam 41 by computer control, and cuts the sheet material with a cutter that moves up and down perpendicularly from the cutting head 42 to the brush surface 1*s*.

The cut sheet material has the surface covered with a sheet-like sealing vinyl cover 6 supplied from a roll on the carry-out side than the beam 41. The sealing vinyl cover 6 compensates for the sealing of the cutting vinyl cover 5 ripped by the cutter, and prevents lowering of the suction force.

Lastly, the sheet material is moved from the conveyor table 1 to the carry-out side air table 3, and the cut sheet material is taken out. As previously described, if a difference in level exists at the joint portion of the conveyor table 1 and the carry-out side air table 3 on the carry-out side, the stacked state of the sheet material, which is cut to small pieces, may collapse due to the difference in level. Thus, in the present embodiment, the conveyor table 1 is configured so that the difference in level formed between the conveyor table 1 and the carry-out side air table 3 becomes smaller than the prior art. The configurations other than the conveyor table are also devised with the design change of the conveyor table. The configuration related to the conveyor table will be specifically described below.

<Schematic Configuration Near Conveyor Table>

Figure 2:
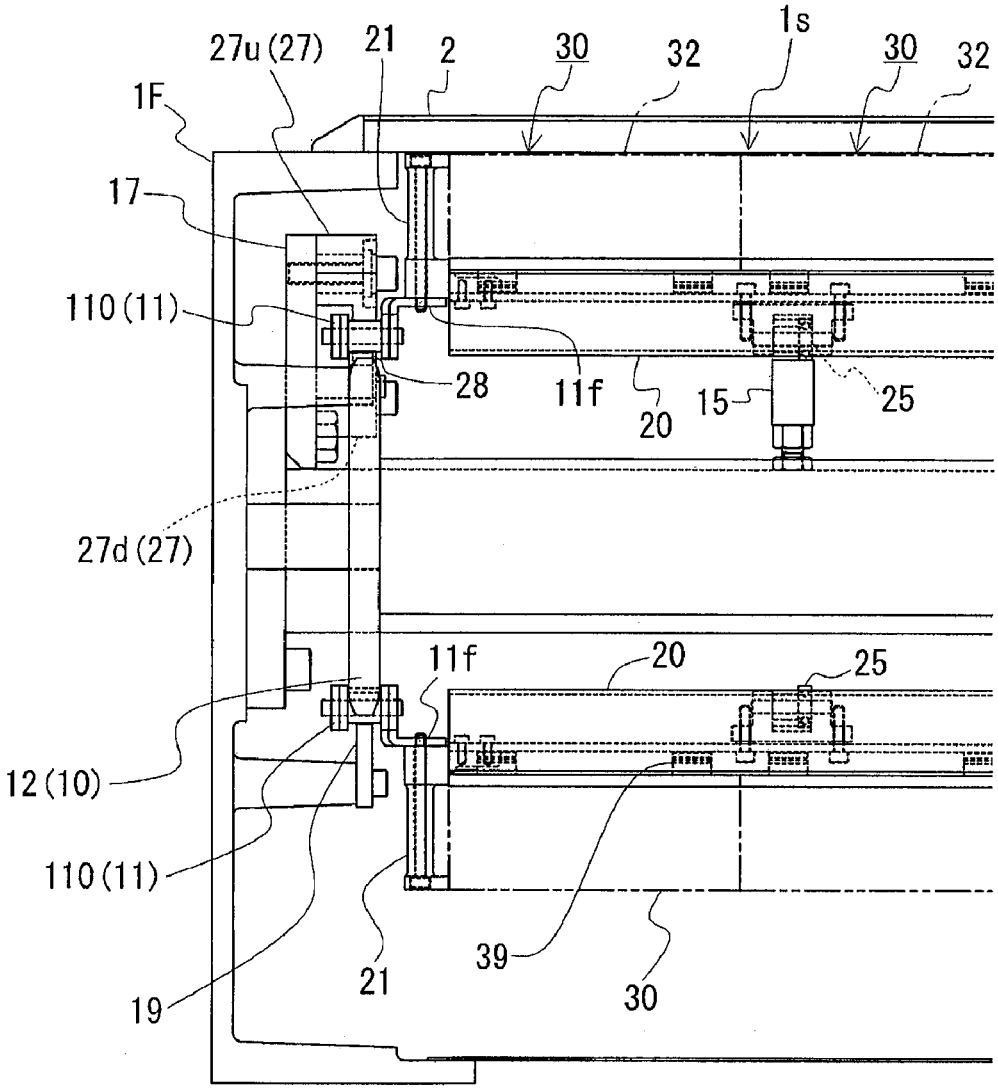
FIG. 2 is a schematic partial perspective view when the conveyor table shown in the embodiment is seen from the carry-in side.

FIG. 1 is a schematic longitudinal cross-sectional view of the conveyor table. In the drawing, the near side in the plane of drawing corresponds to the side surface of the cutting machine, the right side in the plane of drawing is the carry-in side, and the left side in the plane of drawing is the carry-out side. FIG. 2 is a schematic partial perspective view when the conveyor table is seen from the carry-in side, and FIG. 3 is a schematic configuration diagram showing a coupling state of the brush mount and the link of the chain. The following description will be basically made with reference to FIGS. 1 to 3.

The conveyor table 1 includes a caterpillar track 10 extending from the carry-in side to the carry-out side and being arranged one on both side surfaces of the cutting machine, a brush mount 20 bridged to connect the caterpillar tracks 10, and a brush block 30 arrayed on the brush mount 20. With such a configuration, the bristle 32 of the brush block 30 exposed to the upper surface of the cutting machine configures the brush surface 1*s*, and the brush surface 1*s* can be moved from the carry-in side to the carry-out side, or from the carry-out side to the carry-in side by moving the caterpillar track 10.

The carry-in side air table 2 and the carry-out side air table 3 are arranged at positions higher than the brush surface 1*s*, and combs 2C, 3C for smoothing the movement of the sheet material are arranged between the conveyor table 1 and the respective air table 2, 3. The combs 2C, 3C are inclined to lower from the air tables 2, 3 towards the brush surface 1*s*, and the distal end thereof is in a state pierced to the brush surface 1*s*, that is, a state in which the distal ends of the teeth of the combs 2C, 3C are arranged in the gaps of the bristles 32.

<<Caterpillar Track>>

The caterpillar track 10 includes a pair of sprockets 12, 13 arranged on the carry-in side and the carry-out side, and an endless chain 11 bridged over the sprockets 12, 13. The chain 11 is formed by coupling a plurality of links 110 at a flexible angle to each other. The sprocket 12 arranged on the carry-in side of the caterpillar track 10 is arranged at a position lower than the sprocket 13 on the carry-out side. In the drawing, only the caterpillar track arranged adjacent to one side surface of the cutting machine is illustrated, but actually, another caterpillar track 10 is also arranged adjacent to the other side surface of the cutting machine (far side in the plane of drawing in FIG. 1, right side in the plane of drawing in FIG. 2).

Figure 3A:
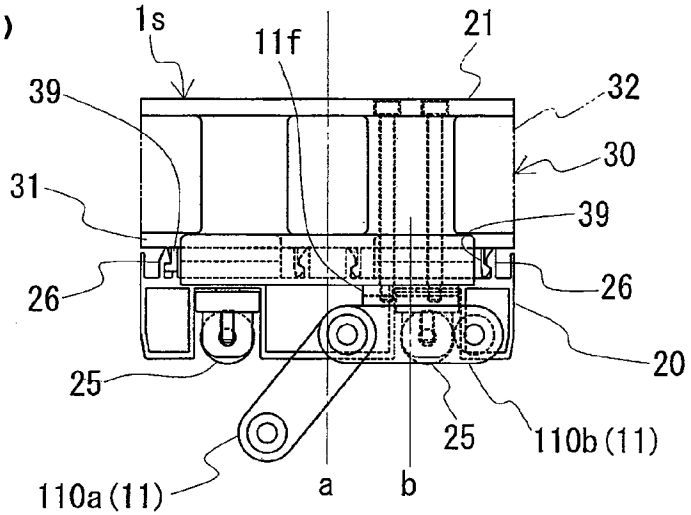
FIGS. 3A and 3B are explanatory views each showing an attachment state of a brush mount with respect to a link of a chain, where (A) is a view seen from a direction orthogonal to the conveying direction and (B) is a view seen from the carry-in side of the conveying direction.
Figure 3B:
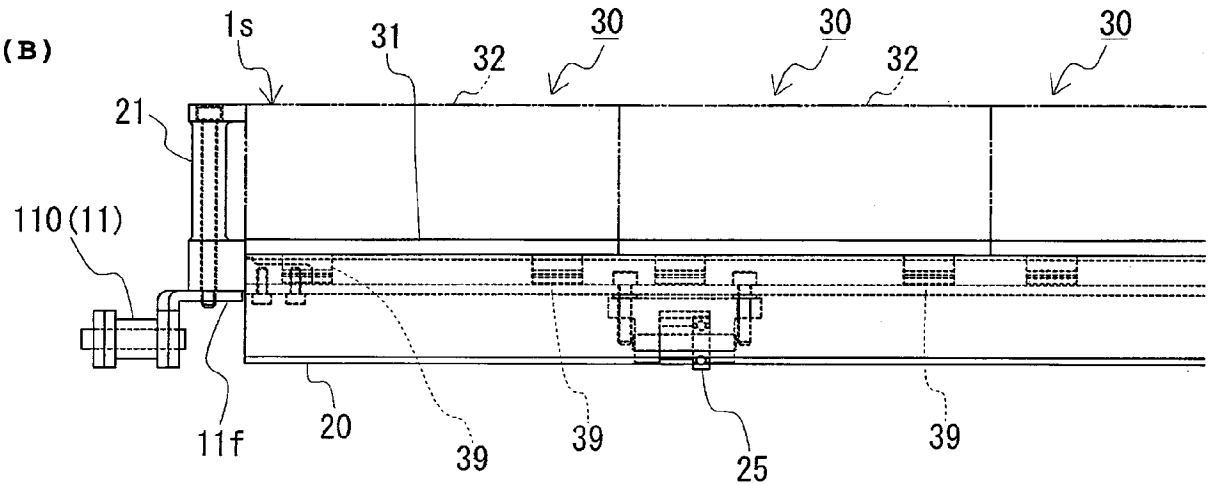
Figure 4A:
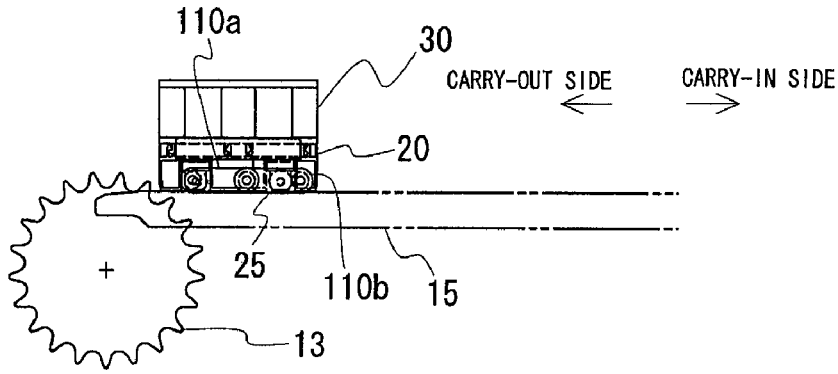
FIG. 4 is a schematic view showing the movement of the brush mount at a corner portion on the carry-out side in time series, and shows a state in which the brush mounts moves in the conveying direction from (A) to (D).
Figure 4B:
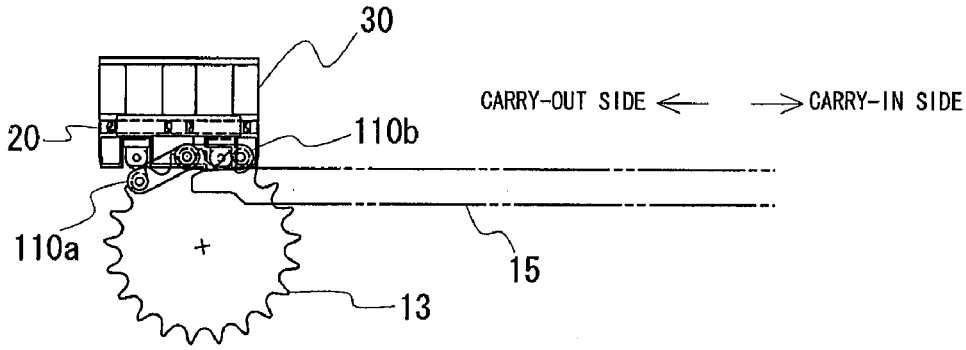
Figure 4C:
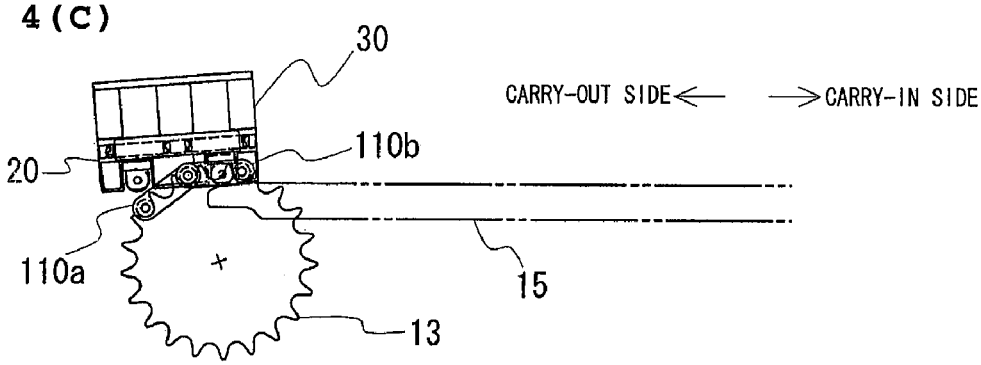
Figure 4D:
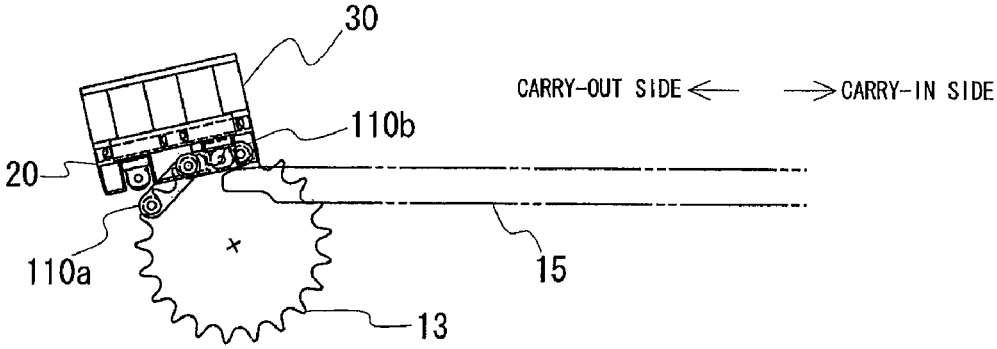

As shown in FIG. 2 and FIG. 3(B), the chain 11 of the caterpillar track 10 includes a fixing portion 11*f* that bends towards the inner side of the conveyor table, so that the brush mount 20 can be fixed to the link 110 through the fixing portion 11*f*, as will be described in detail in the next section.

<<Brush Mount>>

The brush mount 20 is a substantially long plate shaped member extending in a direction orthogonal to the extending direction of the chain 11 so as to be bridged across the two caterpillar tracks 10, and enables the brush block 30 to be arranged on one surface. The brush mount 20 includes a fixing block 21 projecting out to the arranging surface side of the brush block 30 at both ends in the longitudinal direction, and is fixed to the fixing portion 11*f* of the link 110 at the position of the fixing block 21. The fixing block 21 prevents the brush block 30 arranged on the brush mount 20 from detaching from the end of the brush mount 20.

In the present embodiment, one brush mount 20 is fixed with respect to every three links 110. As shown in FIG. 3(A), the brush mount 20 is fixed to the link 110*b* at the portion on the carry-in side, and is not fixed to the link 110*a* at the portion on the carry-out side. That is, a center line b that divides the width direction of the link 110*b*, to which the brush mount 20 is attached, into two is shifted to the carry-in side with respect to a center line a that divides the width direction (left and right direction in the drawing) of the brush mount 20 into two.

The brush mount 20 includes a guiding roller 25 arranged in plurals at a predetermined interval in the longitudinal direction on the inner side than both ends in the longitudinal direction (see FIG. 2). The guiding roller 25 moves on a guiding rail 15 fixed to a frame 1F of the conveyor table 1 and makes the brush mount 20 travel so that the brush surface 1*s* is held in a horizontal state. The guiding rail 15 is a linear long member that extends from the carry-in side towards the carry-out side, and is arranged in plurals in parallel to the caterpillar track 10 to guide the guiding roller 25 from the carry-in side towards the carry-out side. Furthermore, a pair of lower supporting rails 19 is arranged in parallel to the caterpillar track 10 on the lower side of the conveyor table 1 to support the chain 11 brought to the lower side of the conveyor table 1 so that the chain 11 does not sag.

<<Brush Block>>

The brush block 30 includes a plurality of bristles 32 extending from one surface of a rectangular plate member (in particular, see FIG. 3). Each bristle 32 has the positions of the distal ends aligned to form a flat brush surface 1*s* when the brush block 30 is attached to the brush mount 20. A nail portion 39 is formed on the other surface of the rectangular plate member 31, and the brush block 30 is attached to the brush mount 20 by engaging the nail portion 39 and a nail portion 26 of the brush mount 20.

<Effect of Conveyor Table>

According to the conveyor table 1 having the above configuration, the track (see chain dashed line in FIG. 1) drawn by the upper end edge on the carry-in side of the brush block 30 barely projects out from the surface, which is extended from the brush surface 1*s*, at the upper side of the corner portion of the caterpillar track 10 on the carry-out side. The reason for drawing such track will be described based on FIG. 4 and FIG. 5.

FIG. 4 is a schematic view showing the movement of the brush mount at the corner portion on the carry-out side in time series. First, when the brush mount 20 is in the state of FIG. 4(A), the links 110*a*, 110*b* corresponding to the positions of the brush mount 20 are both in the horizontal state, and the brush mount 20 is also in the horizontal state. As the state transitions from (A) to (B), (C), (D), the brush mount 20 tilts following the link 110*b* instead of the link 110*a* since the portion on the carry-in side of the brush mount 20 and the link 110*b* are fixed. In this case, the starting point of the tilt of the brush mount 20 becomes the turning axis on the carry-in side of the link 110*b*. Since the track drawn by the upper end edge becomes larger the greater the distance between the starting point of the tilt and the upper end edge on the carry-in side of the brush block 30, the track becomes smaller on the carry-out side the more the starting point of the tilt is deviated towards the carry-in side.

Figure 5:
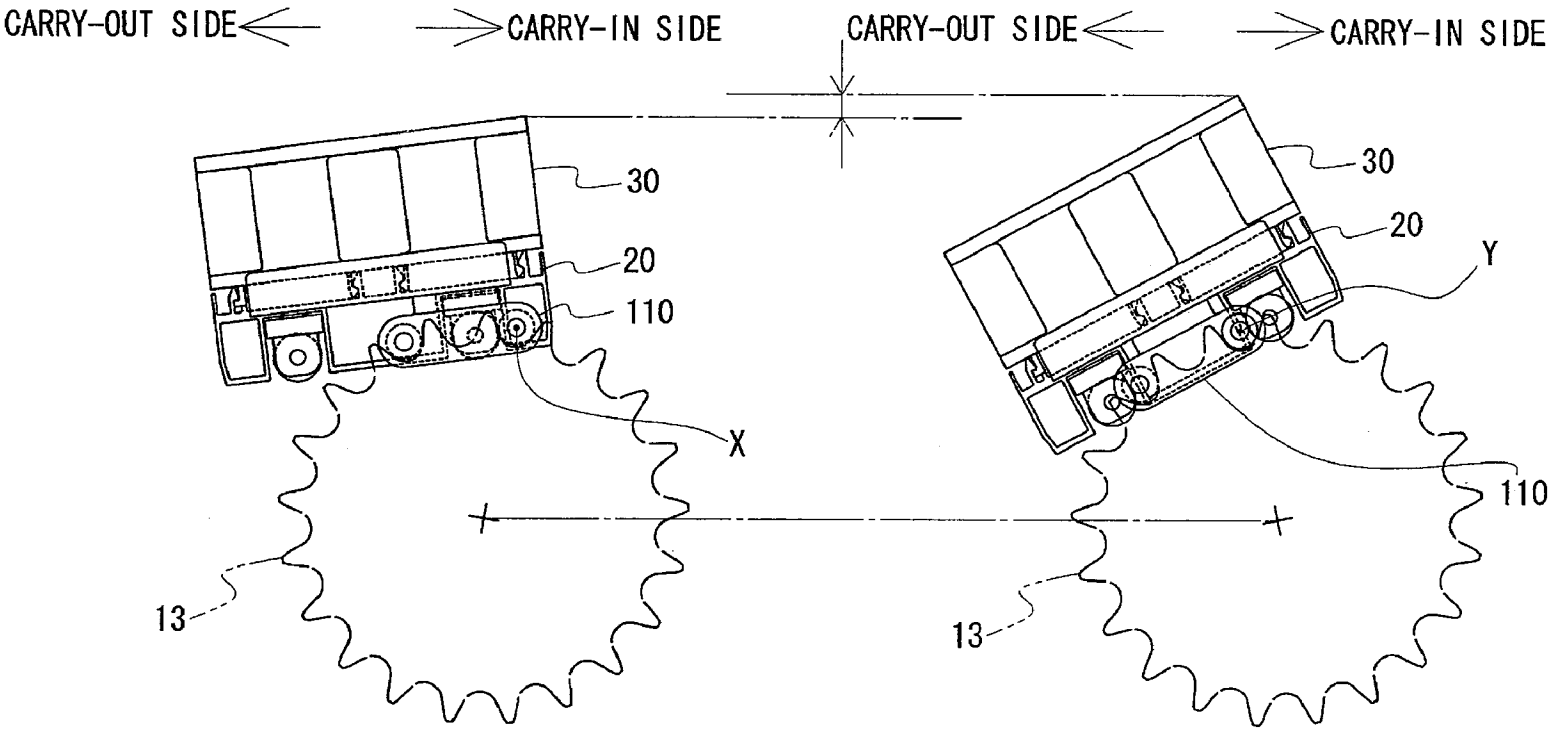
FIG. 5 is an explanatory view comparing the highest points of the track of the brush block of the conveyor table shown in the embodiment and the track of a brush block of a conveyor table having a conventional configuration.
Figure 6A:
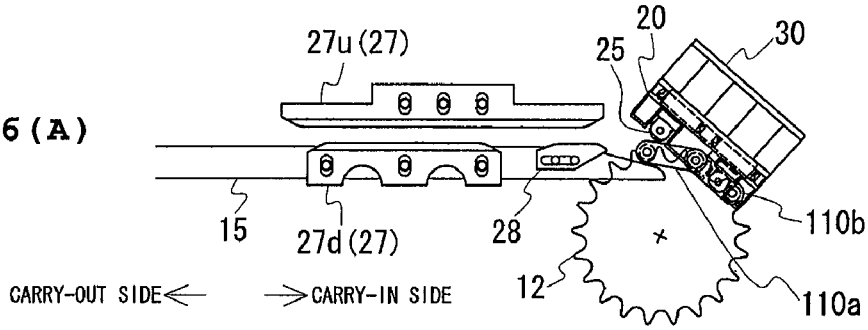
FIG. 6 is a schematic view showing the movement of the brush mount at the corner portion on the carry-in side in time series, and shows a state in which the brush mounts moves in the conveying direction from (A) to (D).
Figure 6B:
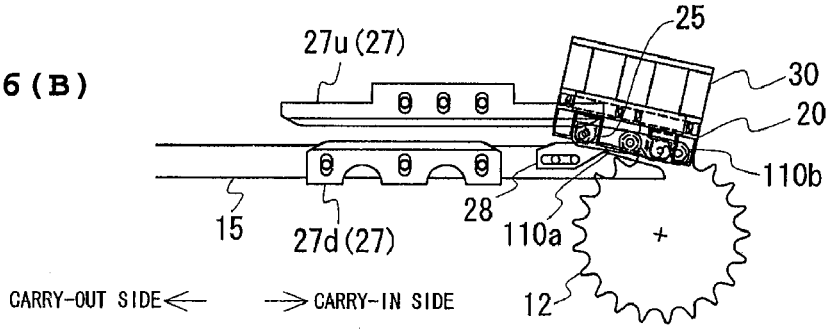
Figure 6C:
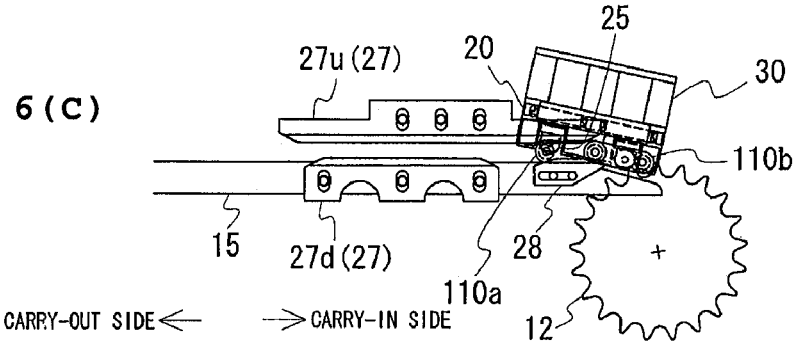
Figure 6D:
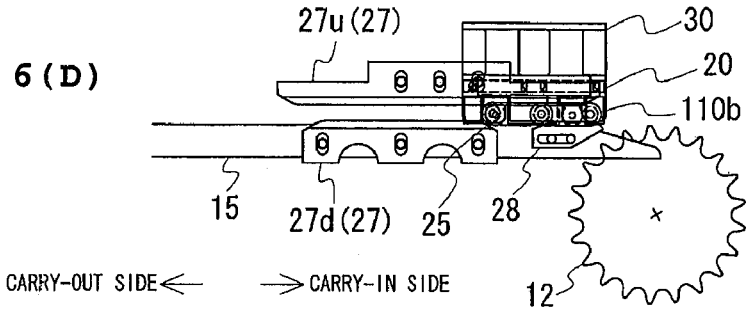

FIG. 5 shows a view comparing the highest points of the track of the brush block of the conveyor table shown in the present embodiment and the track of the brush block of the conventional conveyor table on the carry-out side. In the conventional configuration shown on the right in FIG. 5, the starting point Y of the tilt of the brush mount 20 becomes the turning axis on the carry-in side of the link 110 since the link 110, to which the brush mount 20 is fixed, is at the middle of the brush mount 20. In the present embodiment shown on the left in FIG. 5, on the other hand, the starting point X of the tilt of the brush mount 20 becomes the turning axis on the carry-in side of the link 110 since the link 110, to which the brush mount 20 is fixed, is shifted towards the carry-in side from the middle of the brush mount 20. In other words, the starting point X of the tilt of the present embodiment is deviated towards the carry-in side than the starting point Y of the tilt of the conventional structure. The upper end edge on the carry-in side of both brush blocks 30 reaches the highest point when the line connecting the starting point and the upper end edge is perpendicular, where the highest point of the track in the present embodiment is low compared to the highest point of the track in the conventional configuration, as shown in the drawing. Thus, as shown in FIG. 1, the difference in level between the brush surface 1*s* and the carry-out side air table 3 can be made smaller than that of the prior art, so that the sheet material is prevented from collapsing due to the difference in level when conveying the sheet material from the conveyor table 1 to the carry-out side air table 3.

On the carry-in side, on the other hand, the track drawn by the upper end on the carry-out side of the brush block 30 is bulged out to the upper side, and the projecting amount of the track from the brush surface 1*s* (see chain dashed line on carry-in side in FIG. 1) becomes large compared to the carry-out side. In the present embodiment, the projecting amount of the track from the brush surface 1*s* is suppressed to the same extent as the prior art since the sprocket 12 on the carry-in side is arranged to be lower than the sprocket 13 on the carry-out side. Thus, the difference in level between the brush surface 1*s* and the carry-in side air table 2 is the same extent as the prior art, and the sheet material is prevented from collapsing due to the difference in level when conveying the sheet material from the carry-in side air table 2 to the conveyor table 1.

<Other Configurations>

On the carry-in side, the carry-out side of the brush mount 20 tends to be lifted up by the slidable contact of the bristle 32 and the comb 2*c* when the bristle 32 of the brush block 30 arranged on the brush mount 20 sent from the sprocket 12 passes the carry-in side comb 2*c*. After the bristle 32 passed the comb 2*c*, the carry-out side of the brush mount 20 that is lifted up lowers, and hence the brush mount 20 tends to easily vibrate. Such vibration causes the gap between the brush blocks 30 adjacent in the conveying direction to open and close, whereby the sheet material and the cutting vinyl cover covering the sheet material may get caught in the gap.

The conveyor table 1 shown in the present embodiment, therefore, includes carry-in side guide rails 27 for stabilizing the brush mount 20 fixed to the chain 11 by sandwiching the chain 11 (link 110) sent from the sprocket 12 from above and below at near the carry-in side comb 2*c* (carry-in side end) to a horizontal state. The carry-in side guide rails 27 merely need to be formed in a range where the vibration of the brush mount 20 can be suppressed while the bristle 32 contacts the comb 2*c* when the brush mount 20 moves in the conveying direction. In the present embodiment, as shown in FIG. 2, the guide rails 27 are configured by an upper guide rail 27*u* and a lower guide rail 27*d* projecting to the inner side of the table 1 from the plate-shaped piece 17 supported by the frame 1F on the side surface of the conveyor table 1. The distal ends of the respective guide rails 27*u*, 27*d* project out in a direction of facing each other, and the turning axis of the link 110 is sandwiched by such projections. The upper guide rail 27*u* is formed up to the position of overlapping the sprocket 12 in the conveying direction, and the lower guide rail 27*d* has the carry-in side formed shorter than the upper guide rail 27*u* (see FIGS. 1 and 6). Each of the guide rails 27*u*, 27*d* includes a plurality of long holes extending in the up and down direction of the conveyor table 1, so that the upper and lower positions of each of the guide rails 27*u*, 27*d* can be adjusted by adjusting the screw-fitting position with respect to the plate-shaped piece 17.

A guide cam 28 for guiding the chain 11 to the guide rails 27 is arranged between the lower guide rail 27*d* and the sprocket 12 (see FIGS. 1, 2, 6). The chain 11 can be smoothly guided to the guide rails 27 while lifting the link 110 of the chain 11 fed from the sprocket 12 up to the horizontal position to resolve the difference in height between the sprockets 12, 13 by the guide cam 28. The guide cam 28 is inclined such that the upper surface lowers towards the sprocket 12 side so that the chain 11 can be gradually lifted up to the horizontal position. The guide cam 28 is also supported by the frame 1F of the conveyor table 1 (see FIG. 2). The guide cam 28 includes a long hole extending in the conveying direction, so that the position in the conveying direction of the guide cam 28 can be adjusted. The guide cam 28 and the lower guide rail 27*d* may be integrally formed.

FIG. 6 is a schematic view showing the movement of the brush mount 20 at the corner portion on the carry-in side in time series. When the brush mount 20 transitions from the state of FIG. 6(A) to the state of FIG. 6(B), the link 110*a*, to which the brush mount 20 is not fixed, first rides on the guide cam 28. At the same time, the guiding roller 25 on the far side in the plane of drawing rides on the guiding rail 15, and the brush mount 20 travels on the guiding rail 15. When the state transitions from (B) to (C), the link 110*b*, to which the brush mount 20 is fixed, rides on the guide cam 28. Then, when the state transitions from (C) to (D), the link 110*b* is sandwiched by the guide cam 28 and the upper guide rail 27*u*, and is lifted up to resolve the difference in height of the carry-out side sprocket (not shown) and the carry-in side sprocket 12. In this case, the link 110*b* is held in a horizontal state, and thus the brush mount 20 fixed to the link 110*b* also becomes horizontal. Furthermore, when the chain 11 is moved to the carry-out side from the (D) state, the link 110*b* is guided to between the upper guide rail 27*u* and the lower guide rail 27*d* while maintaining a horizontal state. Since the chain 11 sandwiched by the guide rails 27 stabilizes in the horizontal state (see FIG. 1), the brush mount 20 does not lift up by the friction between the bristle 32 of the block 30 and the comb 2C when the brush block 30 passes the carry-in side comb 2C, and the cutting vinyl cover and the sheet material are prevented from being caught between the brush blocks 30 adjacent in the conveying direction.

As shown in FIG. 1, carry-out side guide rails 29 for stably holding the horizontal state of the brush mount 20 by sandwiching the chain 11 from above and below are also arranged near the comb 3*c* on the carry-out side (carry-out side end). The carry-out side guide rails 29 have a shape substantially symmetric to the carry-in side guide rails 27. The carry-out side guide rails 29 are arranged because the carry-in side of the brush mount 20 has a possibility of being lifted up on the carry-out side as well, when the bristle 32 of the brush block 30 slidably contacts the carry-out side comb 3C. In other words, a gap is prevented from forming between the brush blocks 30 adjacent in the conveying direction before the comb 3C on the carry-out side by sandwiching the chain 11 with the guide rails 29, thereby preventing the cutting vinyl cover and the sheet material from being caught in the gap. The carry-out side guide rails 29 may also be formed in a range where the vibration of the brush mount 20 can be suppressed while the bristle 32 contacts the comb 3C when the brush mount 20 moves in the conveying direction, similar to the carry-in side guide rails 27.

The embodiment of the present invention is not limited to the configurations described above, and may be appropriately modified within a scope not deviating from the gist of the invention. For instance, the projecting amount of the track of the brush block from the brush surface can be made small by having the diameter of the carry-in side sprocket smaller than that of the carry-out side sprocket instead of lowering the carry-in side sprocket. In addition, the brush mount 20 is fixed to the link 110 of the chain 11 at the position of the fixing portion 21 in the above-described embodiment, but may be fixed to the link 110 at the position of the lower surface of the brush mount 20.

The invention claimed is:

1. A conveyor table of a cutting machine comprising a pair of caterpillar tracks formed by bridging a chain over a pair of sprockets arranged at a carry-in side end and a carry-out side end in a conveying direction, a plurality of brush mounts attached to the chain in parallel so as to connect the caterpillar tracks, and a brush block having bristles arrayed on each of the brush mount; wherein the brush mount is configured so that a portion on the carry-in side is fixed to the chain and a portion on the carry-out side is not fixed to the chain.

2. The conveyor table of the cutting machine according to claim 1, wherein the sprocket on the carry-in side is arranged at a position lower than the sprocket on the carry-out side.

3. The conveyor table of the cutting machine according to claim 2, comprising a guide cam for pushing up the chain sent from the sprocket on the carry-in side to reduce a difference in height between the carry-in side sprocket and the carry-out side sprocket.

4. The conveyor table of the cutting machine according to claim 1, wherein the conveyor table includes a carry-in side guide rail for suppressing vibration of the brush mount by sandwiching the chain from above and below near the carry-in side end at the upper surface side thereof.

5. The conveyor table of the cutting machine according to claim 1, wherein the conveyor table includes a carry-out side guide rail for suppressing vibration of the brush mount by sandwiching the chain from above and below near the carry-out side end at the upper surface side thereof.

* * * * *